US012669302B2

(12) United States Patent
Knott

(10) Patent No.: US 12,669,302 B2
(45) Date of Patent: Jun. 30, 2026

(54) FIREARM SUPPRESSOR

(71) Applicant: Wedge Tail Industries R&D Pty Ltd, Camberwell (AU)

(72) Inventor: Alexander Charles Knott, Victoria (AU)

(73) Assignee: Wedge Tail Industries R&D Pty Ltd, Camberwell (AU)

( * ) Notice: Subject to any disclaimer, the term of this patent is extended or adjusted under 35 U.S.C. 154(b) by 53 days.

(21) Appl. No.: 18/722,075

(22) PCT Filed: Dec. 23, 2022

(86) PCT No.: PCT/AU2022/051594
§ 371 (c)(1),
(2) Date: Jun. 20, 2024

(87) PCT Pub. No.: WO2023/115168
PCT Pub. Date: Jun. 29, 2023

(65) Prior Publication Data

US 2025/0130005 A1 Apr. 24, 2025

(30) Foreign Application Priority Data

Dec. 24, 2021 (AU) ..... 2021904280

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4
See application file for complete search history.

(56) References Cited

U.S. PATENT DOCUMENTS

2021/0041200 A1* 2/2021 Kras ..... F41A 21/30
2023/0417507 A1* 12/2023 Kras ..... F41A 21/34

* cited by examiner

*Primary Examiner* — Samir Abdosh
(74) *Attorney, Agent, or Firm* — Honigman LLP

(57) ABSTRACT

A firearm suppressor including an inner chamber and an outer chamber surrounding the inner chamber, wherein the firearm suppressor includes at least one vane, the vane having an edge across which fluid flows, said edge of the vane having a labyrinth weir formation to assist with energy dissipation as the fluid flows across the labyrinth weir.

18 Claims, 13 Drawing Sheets

FIREARM SUPPRESSOR

FIELD OF THE INVENTION

The present invention relates to a firearm suppressor for suppressing noise of a firearm.

BACKGROUND TO THE INVENTION

A firearm suppressor is a gas flow control structure that aims to alter the discharge rate of the gas flow to atmosphere and thereby reduce the intensity of the muzzle report.

American inventor Hiram Percy Maxim developed an early silencer, obtaining U.S. Pat. No. 916,885 in 1909.

An example definition of a suppressor is as follows: also known as a silencer, suppressor or sound moderator, is a muzzle device that reduces the acoustic intensity of the muzzle report (sound of a gunshot) and the recoil when a gun (firearm or air gun) is discharged, by modulating the speed and pressure of the propellant gas from the muzzle and hence suppressing the muzzle blast. Like other muzzle devices, a silencer can be a detachable accessory mounted to the muzzle, or an integral part of the barrel.

A typical silencer is a metallic cylinder containing internal baffles, with a hollow bore to allow the projectile (bullet) to exit normally. During firing, the projectile passes through the bore with little hindrance, but most of the expanding gas ejecta behind it is retained through a longer and convoluted escape path created by the baffles, prolonging the release time. This slows down the gas and dissipates its kinetic energy into a larger surface area, reducing the blast intensity, thus lowering the loudness.

Examples of existing suppressors are disclosed in WO2020/111950, U.S. Pat. No. 9,102,010, US2021/0041200, U.S. Pat. Nos. 10,393,463, 8,286,750, and US2020/0025496. However, the applicant has identified that each of these existing suppressors have limitations which affect their usefulness.

The applicant has identified that there exists a problem in that existing suppressors cause significant over-speeding of automatic firearms such that the firearms are prone to premature wear and failure. The applicant has identified that it would be advantageous to provide a firearm suppressor which avoids or at least minimises firearm over-speeding.

Examples of the present invention seek to provide a firearm suppressor which alleviates or at least ameliorates one or more disadvantages of existing firearm suppressors, or at least provides a useful alternative firearm suppressor.

SUMMARY OF THE INVENTION

In accordance with one aspect of the present invention, there is provided a firearm suppressor including an inner chamber and an outer chamber surrounding the inner chamber, wherein the firearm suppressor includes at least one vane, the vane having an edge across which fluid flows, said edge of the vane having a labyrinth and/or piano key formation.

Preferably, the labyrinth and/or piano key formation enhances energy dissipation. More preferably, the labyrinth and/or piano key formation enhances energy dissipation by extending a length of the edge of the vane when compared to a straight edge.

In a preferred form, the firearm suppressor includes a plurality of vanes, each of the vanes having an edge across which fluid flows, each of said edges having a labyrinth and/or piano key formation.

In accordance with another aspect of the present invention, there is provided a firearm suppressor including an inner chamber and an outer chamber surrounding the inner chamber, wherein the firearm suppressor includes at least one vane, the vane having an edge across which fluid flows, said edge of the vane having a formation to extend a length of the edge of the vane when compared to a straight edge.

Preferably, the formation is a zig-zag formation.

In accordance with another aspect of the present invention, there is provided a firearm suppressor including an inner chamber and an outer chamber surrounding the inner chamber, wherein the firearm suppressor includes at least one vane, the vane having an edge across which fluid flows, said edge of the vane having a labyrinth weir formation to assist with energy dissipation as the fluid flows across the labyrinth weir.

Preferably, the labyrinth weir is in the form of a rectangular labyrinth weir, a triangular labyrinth weir, a trapezoidal labyrinth weir and/or a piano key weir.

In a preferred form, at least part of the firearm suppressor is 3D printed. In other forms, the firearm suppressor may be manufactured with different methods other than 3D printing such as stamping or casting.

In one form, the inner chamber is defined by an inner tubular wall and the outer chamber is defined between the inner tubular wall and an outer tubular wall surrounding the inner tubular wall.

In accordance with another aspect of the present invention, there is provided a firearm suppressor including an inner chamber, wherein the firearm suppressor includes at least one vane, the vane having an edge across which fluid flows, said edge of the vane having a labyrinth and/or piano key formation.

Preferably, the firearm suppressor includes a wall defining a bore located on a primary central axial flow path of the firearm suppressor, and wherein the wall includes a labyrinth and/or piano key formation. More preferably, the wall is circular and has said labyrinth and/or piano key formation on an edge of the wall.

In a preferred form, the wall has said labyrinth and/or piano key formation along a circular edge of the wall. More preferably, the wall has said labyrinth and/or piano key formation along an upstream circular edge of the wall.

BRIEF DESCRIPTION OF THE DRAWINGS

Preferred embodiments of the invention will be described, by way of a non-limiting example only, with reference to the accompanying drawings in which.

DETAILED DESCRIPTION

Figure 1C:
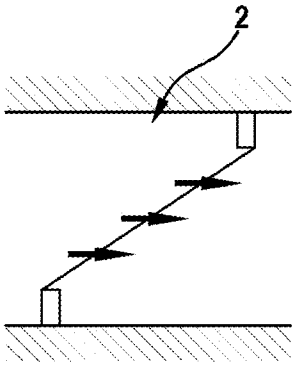
FIG. 1 is a diagrammatic view of flow across different weir types.

With reference to FIGS. 1 to 18 of the drawings, there is depicted a firearm suppressor 10 including an inner chamber 12 and an outer chamber 14 surrounding the inner chamber 12, wherein the firearm suppressor 10 includes at least one vane 16, the vane 16 having an edge 18 across which fluid flows, said edge 18 of the vane 16 having a formation 20 to extend a length of the edge 18 of the vane 16 when compared to a straight edge.

The present applicant has identified that, in hydrology, a device known as a labyrinth weir has been an overflow control structure often used as the crest of spillways and in similar flow regulation applications. The labyrinth weir allows for an increased discharge capacity compared to a straight linear weir.

Figure 1B:
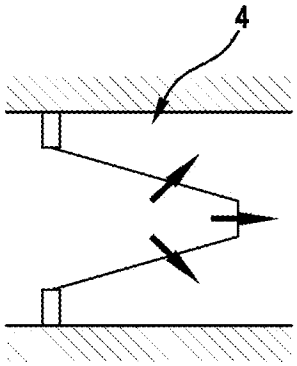
Figure 1A:
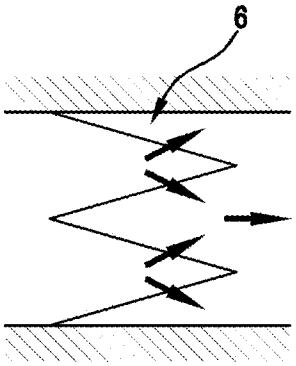

The typical labyrinth weir has a zig-zag plan layout such that its total length is longer than that of a straight linear weir (see FIGS. 1*a* to 1*c*). In particular, FIG. 1*c* shows flow across a diagonal weir type (shown at reference numeral 2), FIG. 1*b* shows flow across a duckbill weir type (shown at reference numeral 4), and FIG. 1*c* shows flow across a labyrinth weir type (shown at reference numeral 6). Significantly, the applicant has identified that such a layout may be used in a firearm suppressor to assist with energy dissipation as fluid passes across vanes within the suppressor which are analogous to weirs.

A labyrinth weir has been used at Hope Mills dam spillway, with a 4.6 m high labyrinth weir in North Carolina, USA, commissioned in 2018.

Figure 2:
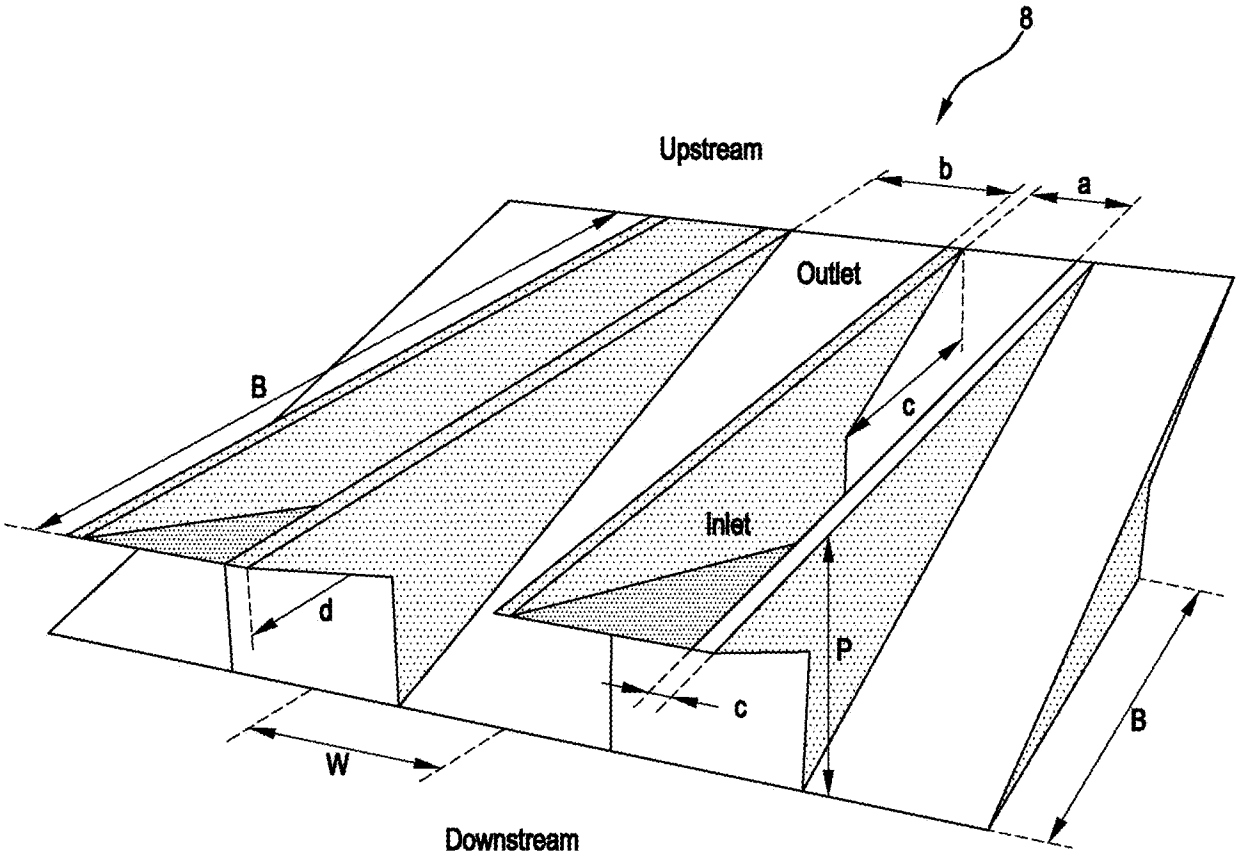
FIG. 2 shows an example of a piano key weir.

FIG. 2 shows an example of a "Piano Key" weir, shown at reference numeral 8. Piano Key weirs are a type of labyrinth weir and are a relatively recent development in the field of spillway hydraulics. They were first developed in the late 1990's and early 2000's as part of an investigation by Hydrocoop (France) and the University of Biskra (Algeria), among others, into improvements for the well-known labyrinth weir (Lempérière & Ouamane 2003).

A Piano Key weir is a rectangular Labyrinth weir featuring inclined aprons with cantilevered apexes, increasing crest length while reducing footprint size. Both Labyrinth and Piano Key weirs are very efficient free surface flow weir solutions.

Figure 3:
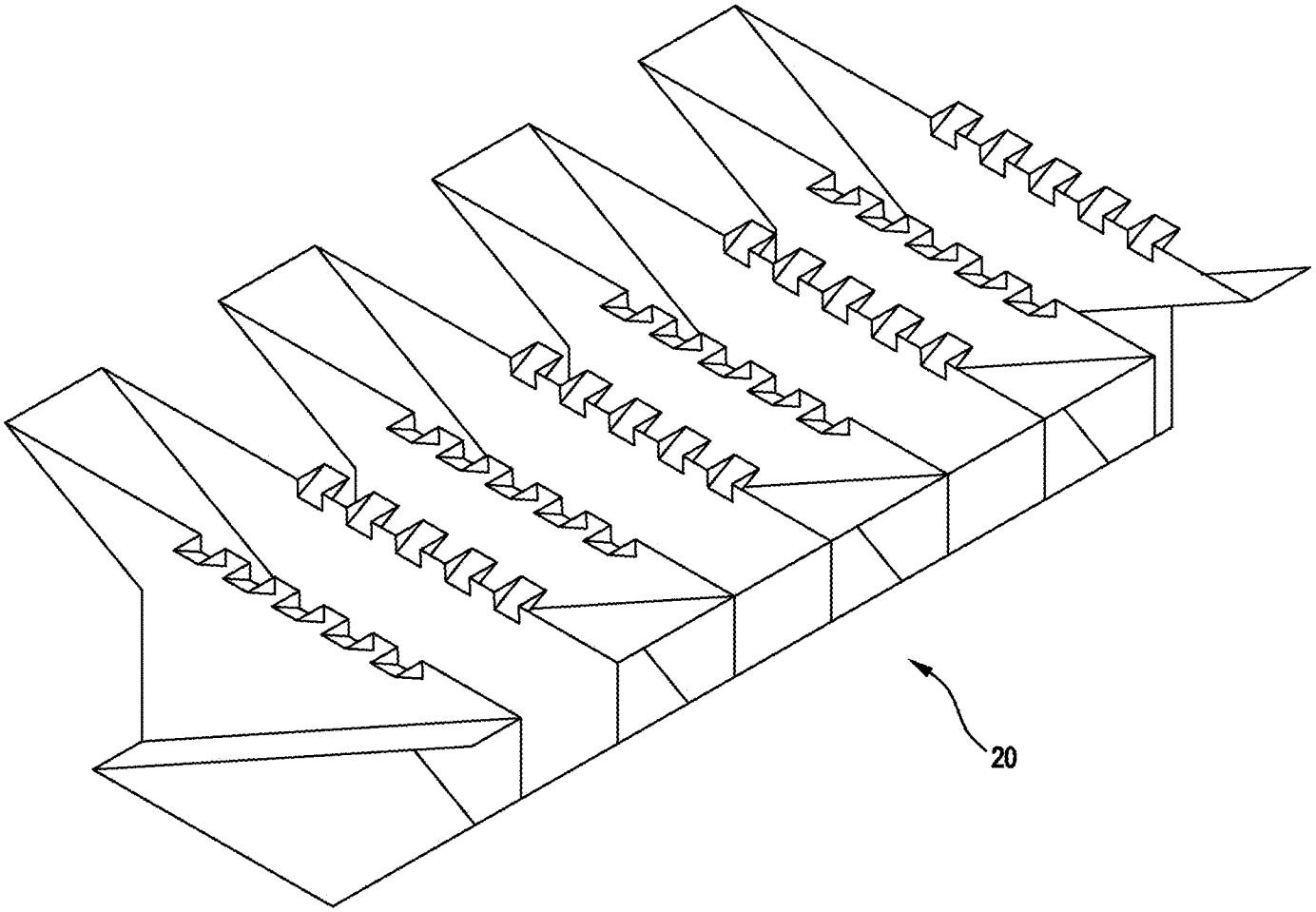
FIG. 3 shows a further example of a piano key weir design.

FIG. 3 shows an example Piano Key formation 20 as a linear array of zig zag patterned flow restricting elements used in a weir to limit flow restriction and associated upstream flooding events.

With regard to existing suppressor designs, the applicant has identified that the devices shown in the documents listed earlier herein do not appear to address the flow restriction that causes backpressure (and associated over speeding on the host weapon system) by using an increase in flow vein edge length (labyrinth) and coaxial expansion volumes within the suppressor design.

EXAMPLE

Figure 4:
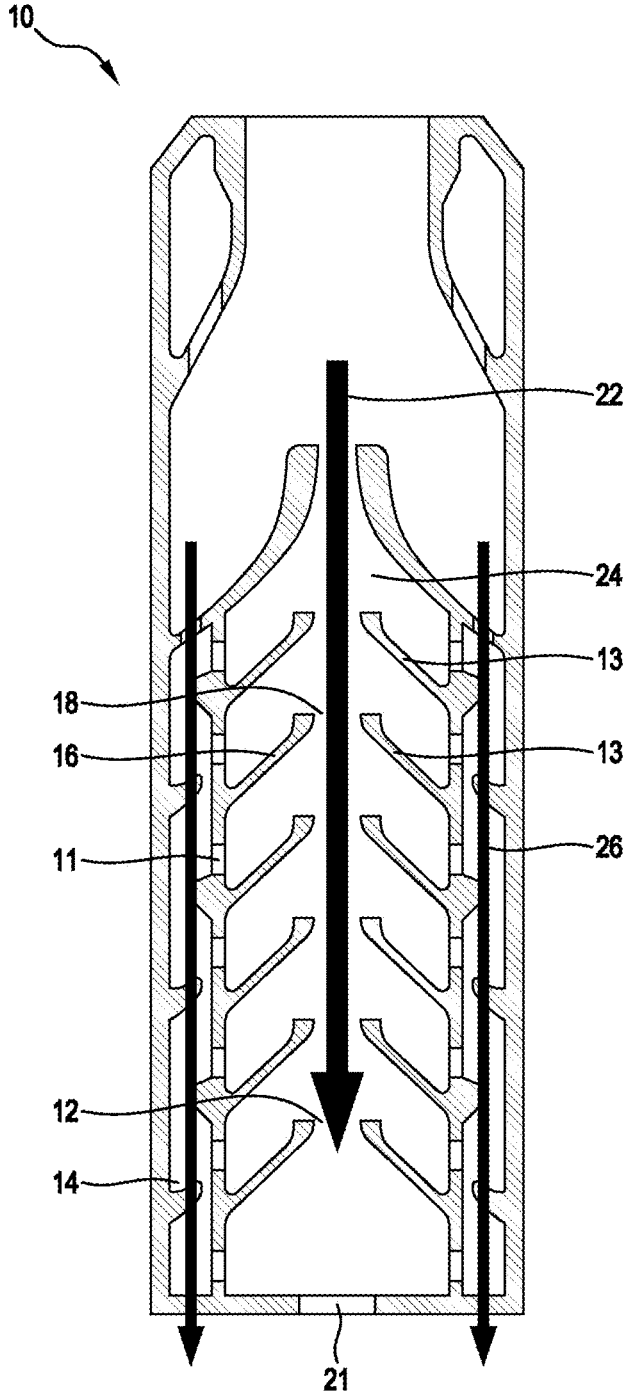
FIG. 4 shows a cross sectional view of a firearm suppressor.
Figure 5:
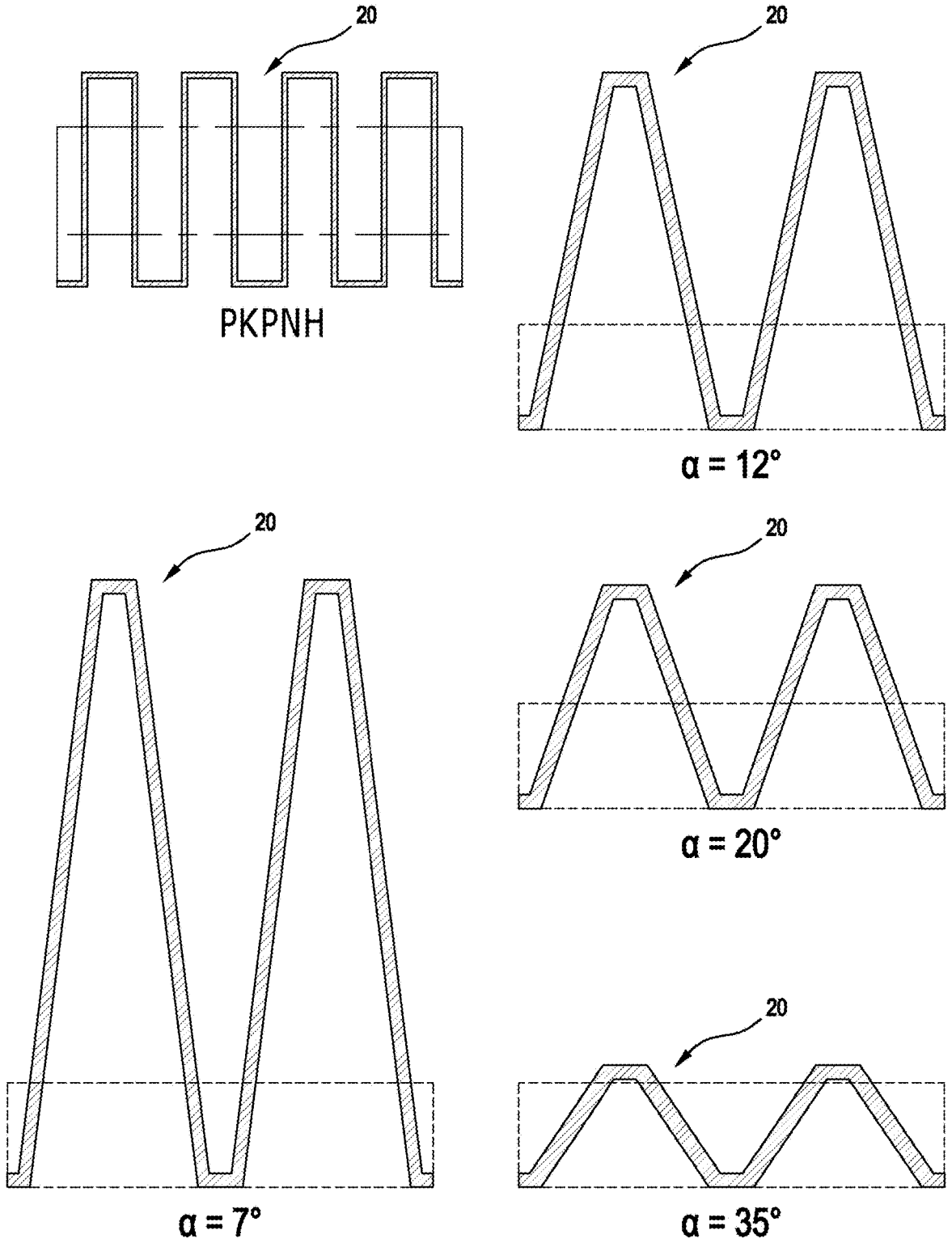
FIG. 5 shows labyrinth weir examples having different configurations and angles.

With reference to FIG. 4, a firearm suppressor (silencer) 10 has a tube 11 and a baffle stack 13 carried within the tube 11. A first inner volume (chamber) 12 is defined by a first inner wall 15 having a first diameter. A secondary outer volume (chamber) 14 is defined by the inner wall 15 and an outer tube 17 (Note: could be tertiary or quaternary too).

Fluid flows co-axially through both the inner chamber 12 and the outer chamber 14.

Figure 10:
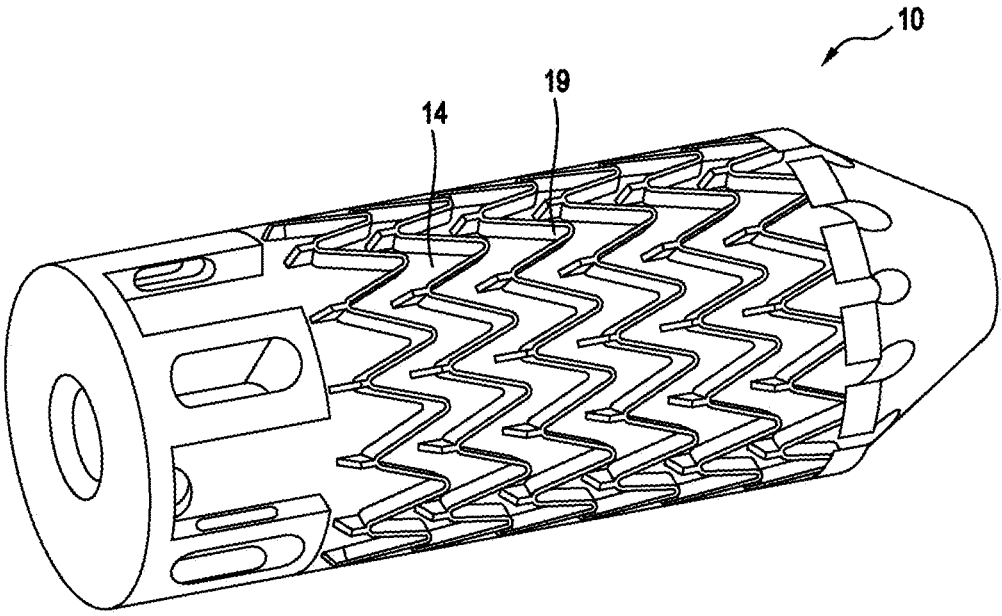
FIG. 10 shows a vane array for the outer chamber (with the outer tube cut away)
Figure 11:
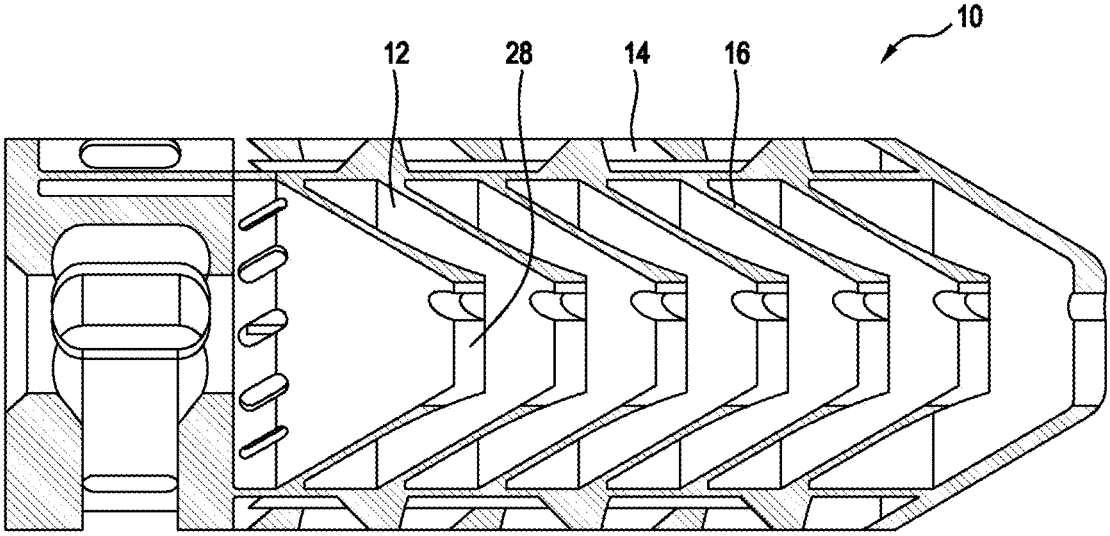
FIG. 11 shows a cross sectional view of an example firearm suppressor without the outer tube.

The outer chamber 14 contains a radial array of outer vanes 19 that form a zig zag pattern wall over which a fluid can pass. These vanes 19 are attached to the inner wall 15 or outer wall (outer tuber 17) in a sequential pattern that allows fluids to flow across the unattached edge. The vane edges 19 can be axially aligned or perpendicular to the bore axis or any angle in between. As shown in FIG. 10, the vanes may be in the form of a series of zig zag shaped arrays extending circumferentially through the outer chamber 14. The zig zag arrays may be spaced longitudinally and may be in sequence or in phase to extend generally in parallel. As shown in FIG. 11, the vanes 19 may alternate between being attached to the inner wall 15 (extending outwardly from the inner wall 15) and the outer tube 17 (extending inwardly from the outer tube 17), so that the fluid path weaves through the outer chamber 14.

The layout is such that a zig zag array is formed and the total length of the vane edge is longer than that of a circumferential edge. The fluid flows over the edge of the vanes 19 and vents to atmosphere via patterned distal ports or via a central annulus in the form of a central aperture 21 (or both).

The inner volume (inner chamber 12) contains radially patterned vanes 16 attached to the inner wall 15 of the inner chamber 12 in a sequential pattern. The vanes 16 allow fluids to flow across the unattached edge 18. The layout is such that a zig zag pattern is formed and the total length of the vane edge 18 is longer than that of a circumferential edge.

The vanes 16 can be axially aligned or perpendicular to the bore axis or any angle in between. The fluid flows over the edge of the vanes 16 and vents to atmosphere via a central annulus in the form of the central aperture 21. At reference numeral 22, a gas flow direction is indicated (arrows are gas flow parts). Reference numeral 24 represents the inner volume showing the inner baffle stack 13. Reference numeral 26 shows the outer volume (outer chamber 14) having the outer vanes 19 which may be in the form of vane type elements in a radial array.

Figure 6:
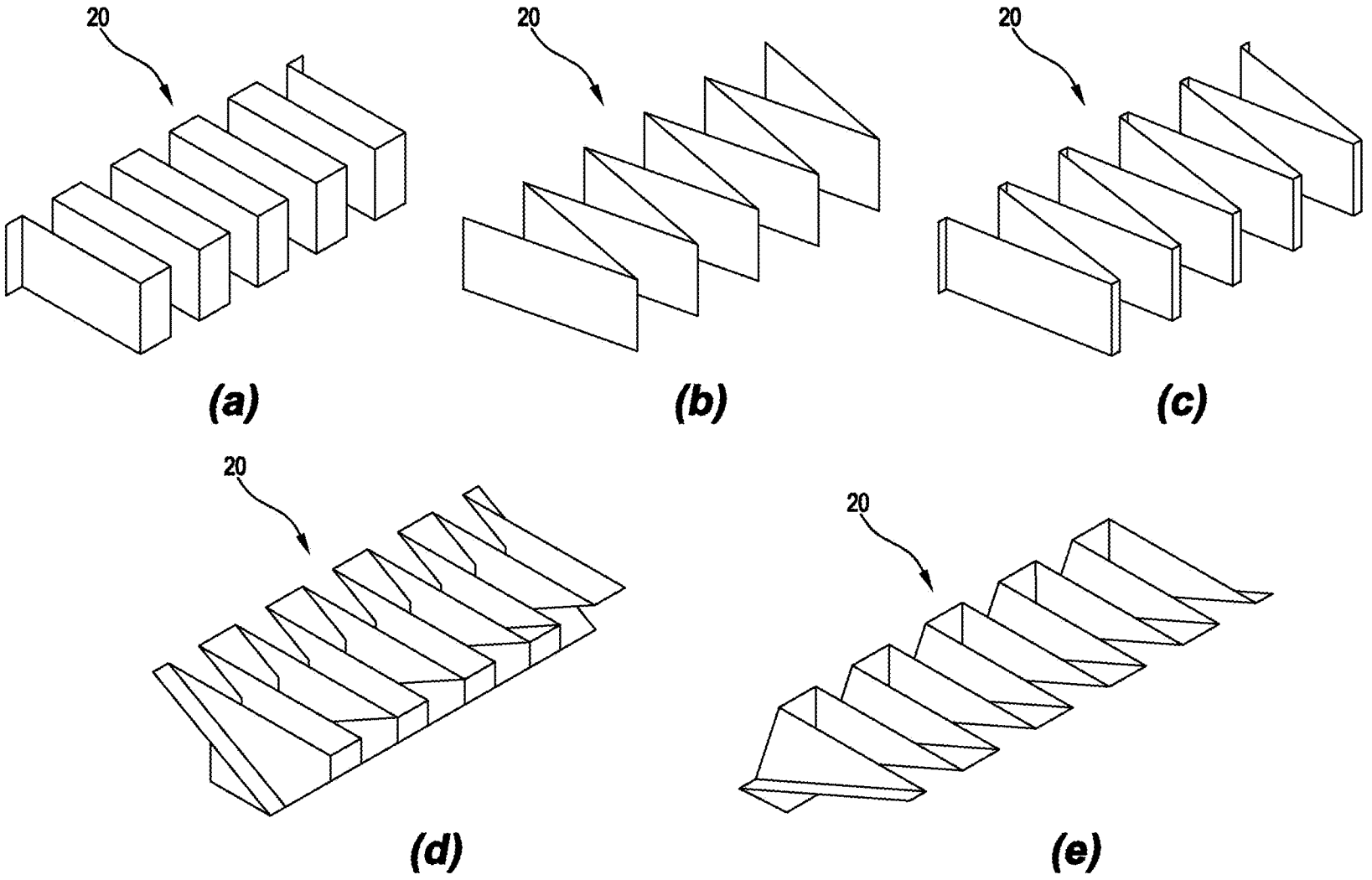
FIG. 6 shows a range of labyrinth weir types and piano key weir types.

With reference to FIG. 6, all vanes described may form rectangular, triangular, or trapezoidal forms and may also have angled faces to further enhance energy dissipation. FIG. 6*a* shows a rectangular labyrinth weir 20, FIG. 6*b* shows a triangular labyrinth weir 20, FIG. 6*c* shows a trapezoidal labyrinth weir 20, FIG. 6*d* shows a piano key weir type A, 20 and FIG. 6*b* shows a piano key weir type C 20.

Figure 7:
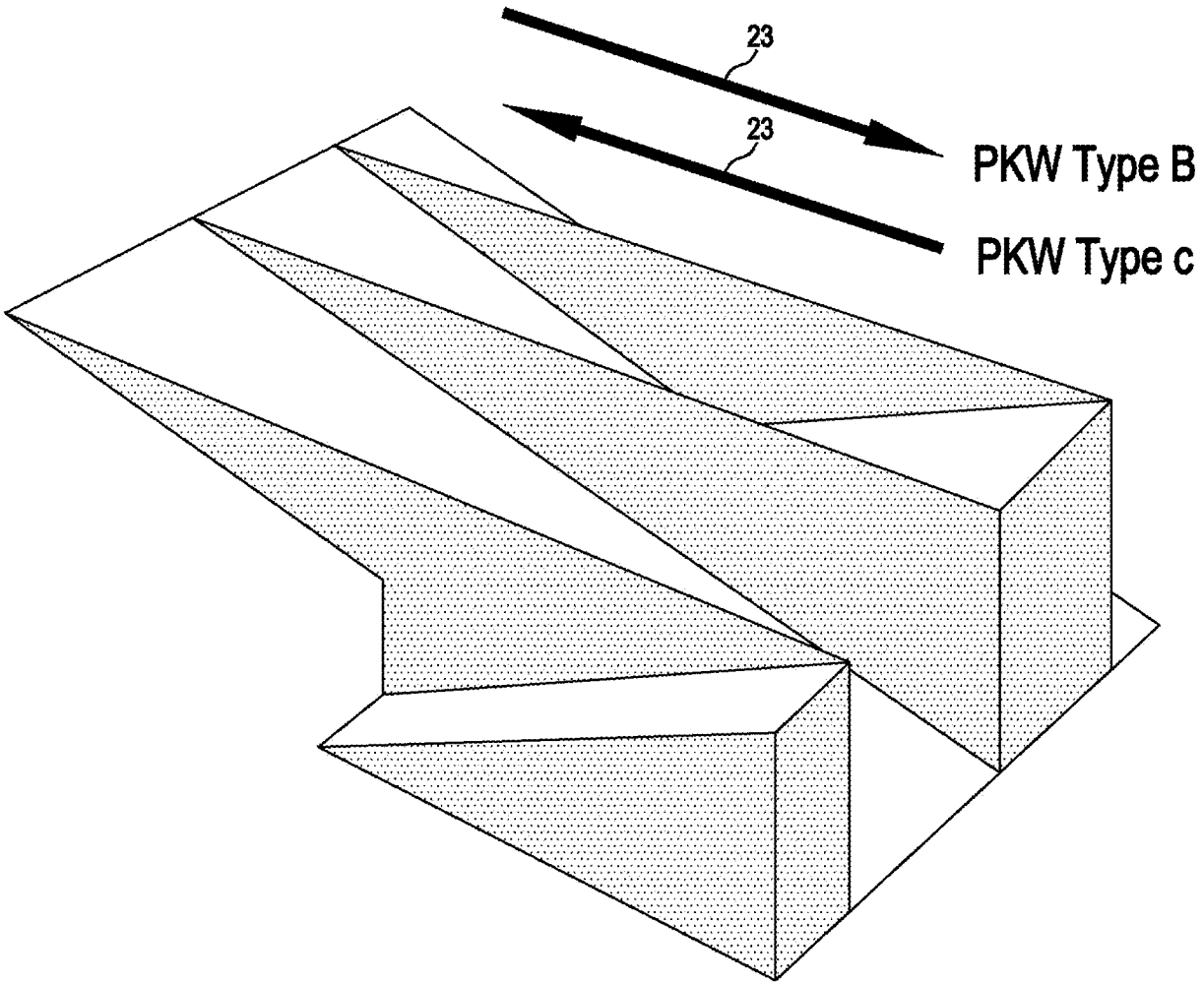
FIG. 7 shows flow across a piano key weir.

With reference to FIG. 7, in the suppressor 10 the gas flow across the vanes having the piano key formation is in the directions noted by the red arrows 23.

Figure 8:
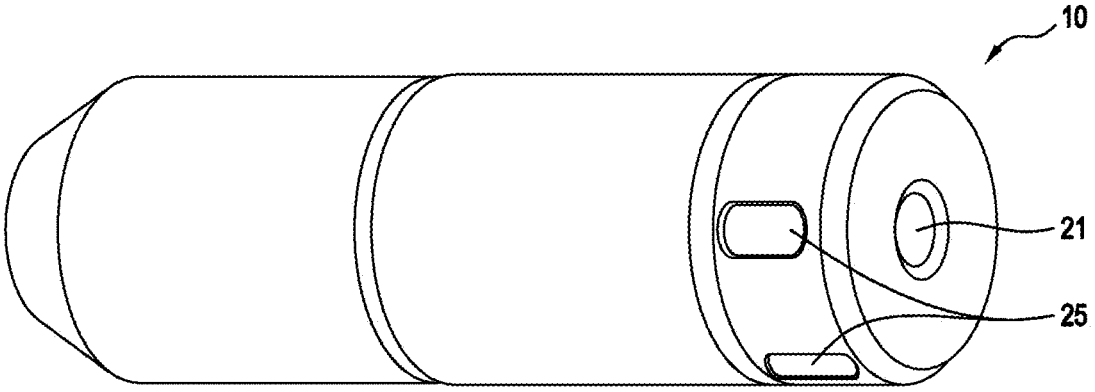
FIG. 8 shows an example firearm suppressor design.

As shown in FIG. 8, there is depicted a suppressor 10 in accordance with a design by the applicant which embodies the principles on labyrinth vane designs in a co-axial arrangement. This prototype features radial exhaust ports 25 for the secondary volume and an annular exhaust port in the form of central aperture 21 for the inner chamber 12 to enhance recoil reduction.

Figure 9:
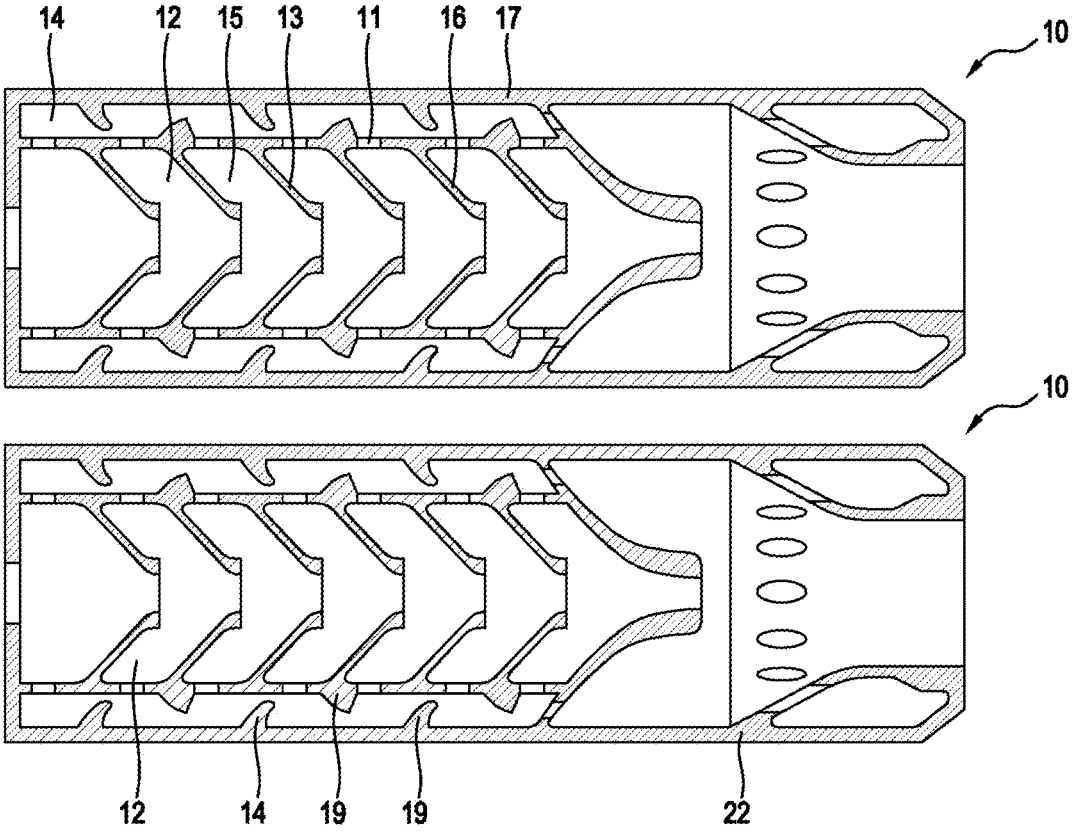
FIG. 9 shows a sectional view of a coaxial firearm suppressor design.

FIG. 9 shows a sectional view of a coaxial prototype design showing the outer labyrinth type vanes 19 attached to the inner and outer surfaces of the secondary volume 14.

Turning to FIG. 10, there is shown an image depicting the vane array 19 for the secondary area (outer chamber 14 with the outer tube 17 cut away). These vanes are in a triangular labyrinth pattern in this instance.

FIG. 11 shows a sectional view with no outer tube 17. The inner chamber vane edges do not have the labyrinth details applied in this instance. Reference numeral 28 shows an inner baffle stack that can also have the labyrinth type vane elements applied to each edge to increase the gas flow.

Figure 12:
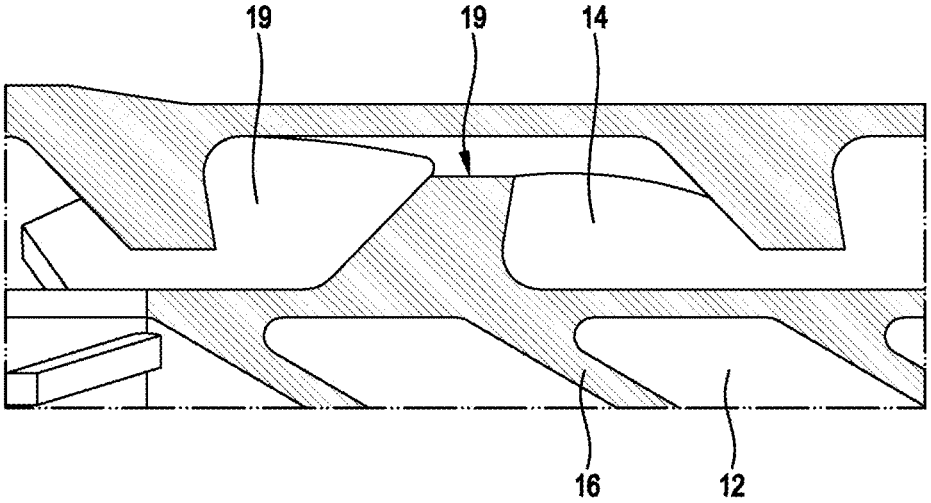
FIG. 12 shows detail of the area allowing the gas flow over the vane elements shown in FIG. 11.

With reference to FIG. 12, there is shown a sectional view depicting the area allowing the gas flow over the vane elements 19. Note that the vane elements 19 are attached to the inner and outer walls for the secondary volume (outer chamber 14) area.

Examples of the firearm suppressor 10 may be manufactured by 3D printing. In other forms, the firearm suppressor may be manufactured with different methods other than 3D printing such as stamping or casting. The firearm suppressor may be configured to facilitate these alternative manufacturing methods; in particular, the outer chamber may be omitted and the absence of the outer chamber may be compensated by providing additional labyrinth and/or piano key formations in other parts of the firearm suppressor 10.

Accordingly, with reference to FIGS. 13 to 18, in another aspect of the present invention, there is provided a firearm suppressor 10 including an inner chamber 12, wherein the firearm suppressor 10 includes at least one vane 16, the vane 16 having an edge 18 across which fluid flows. The edge 18 of the vane 16 has a labyrinth and/or piano key formation.

Figure 13:
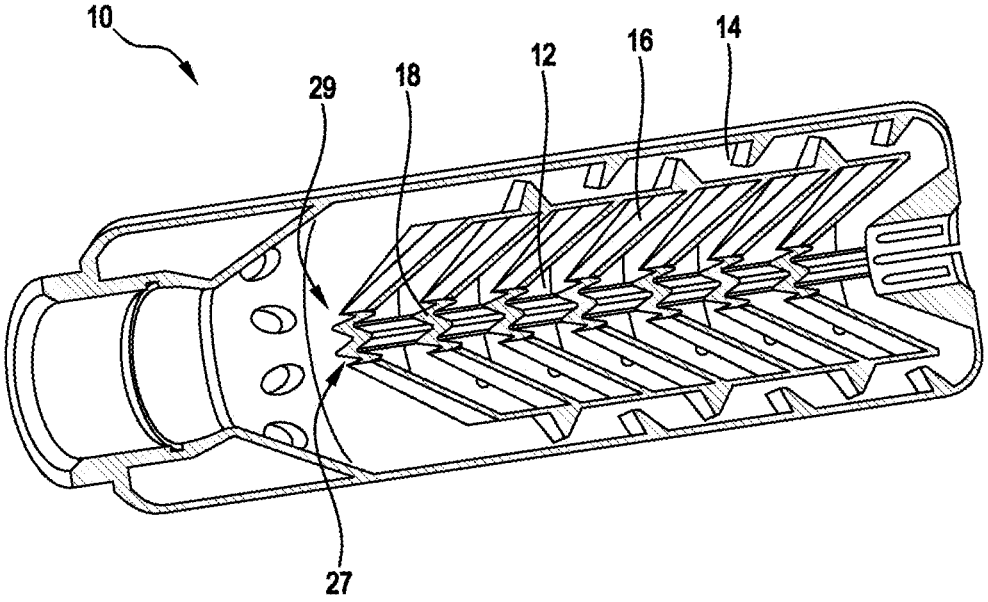
FIG. 13 shows a rear perspective sectional view of a suppressor in accordance with another example.
Figure 14:
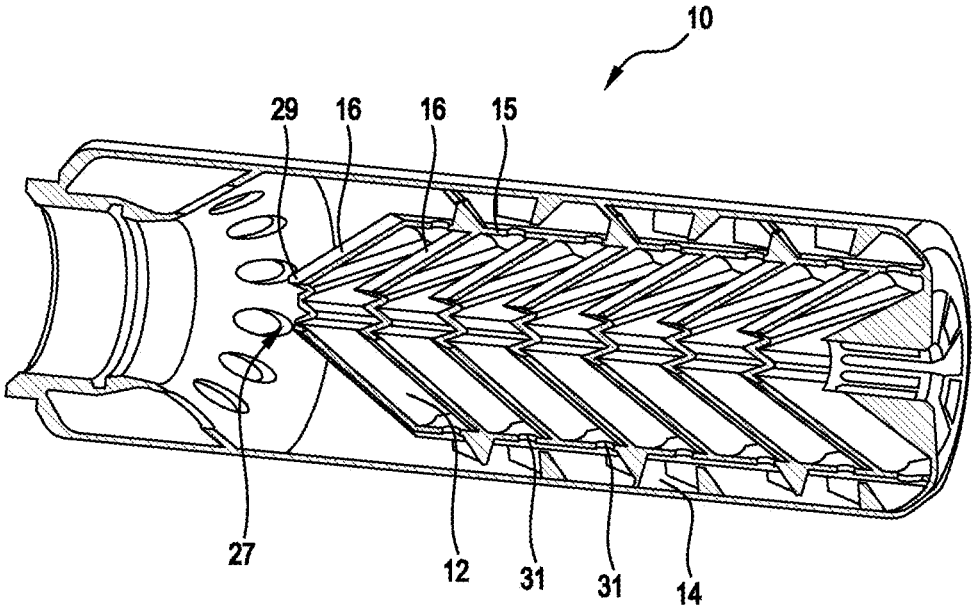
FIG. 14 shows a front perspective sectional view of the suppressor of FIG. 13.

The edge 18 of the vane 16 may be in the form of a crowned circular wall 27 forming a central bore, and may resemble a cake icing nozzle or piping nozzle (see FIGS. 13 and 14). Forming of the edge of the circular wall 27 in this way may significantly increase the length of the edge 18 surface so as to facilitate more gas flow with less back pressure.

Figure 18:
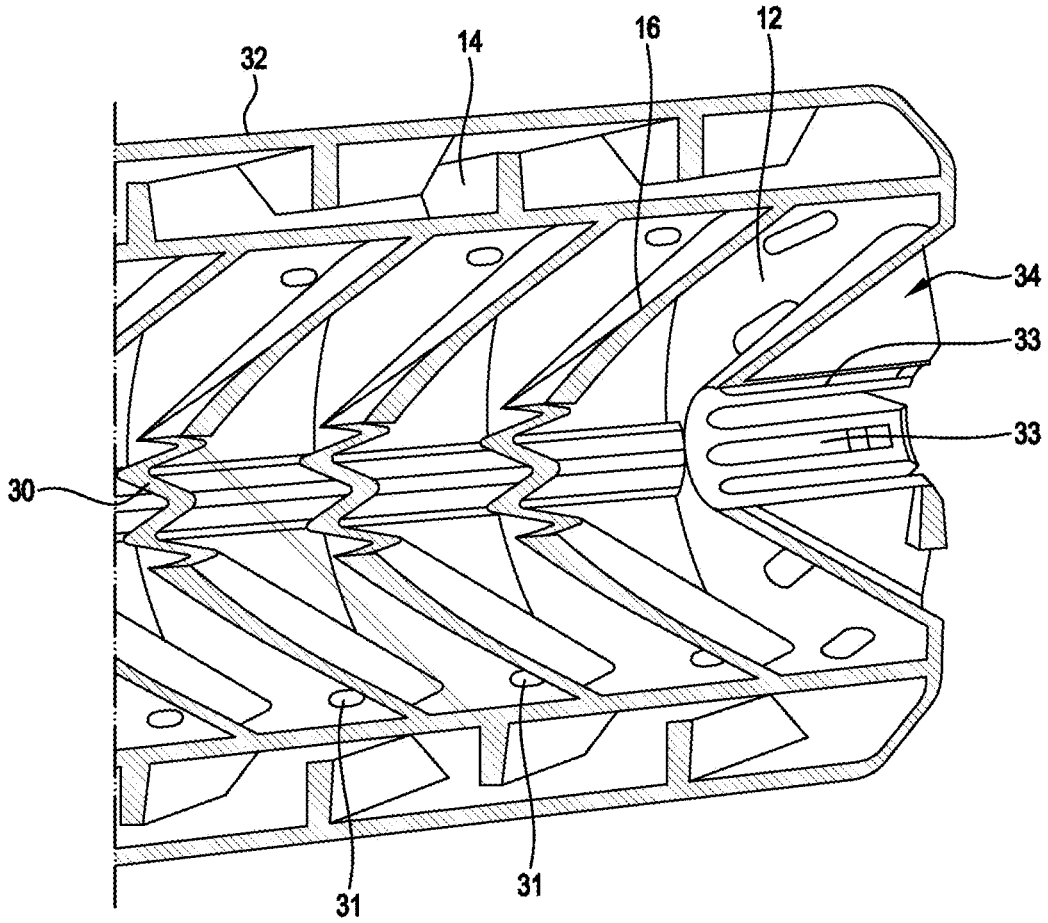
FIG. 18 shows an internal sectional view of a front end portion of the suppressor.

More specifically, the firearm suppressor 10 may include a wall 29 defining a bore located on a primary central axial flow path of the firearm suppressor 10, the wall including a labyrinth and/or piano key formation. As depicted in FIGS. 13, 14 and 18, the wall 29 formed at the edge 18 of the vane 16 may be circular with the labyrinth and/or piano key formation 30 on an edge of the wall 29.

Accordingly, as will be appreciated by those skilled in the art, in the example shown in FIGS. 13 to 18 of the drawings, the wall 29 has the labyrinth and/or piano key formation along the circular edge 18 of the wall 29. In particular, the wall 29 has the labyrinth and/or piano key formation 30 along an upstream circular edge of the wall 29, given the direction of fluid flow through the firearm suppressor 10. The sectional views in FIG. 13 and FIG. 14 show the suppressor 10 with the labyrinth geometry application to the bore baffles in the primary central axial flow path. Use so show exit details radial spear spurts the gases as much as possible.

In particular, the inner wall 15 may be provided with one or more radial apertures 31 to allow gas to flow between the inner chamber 12 and the outer chamber 14. As shown in FIG. 13 and FIG. 14, the inner wall 15 may be provided with a separate aperture 31 between each pair of neighbouring vanes 16.

Figure 15:
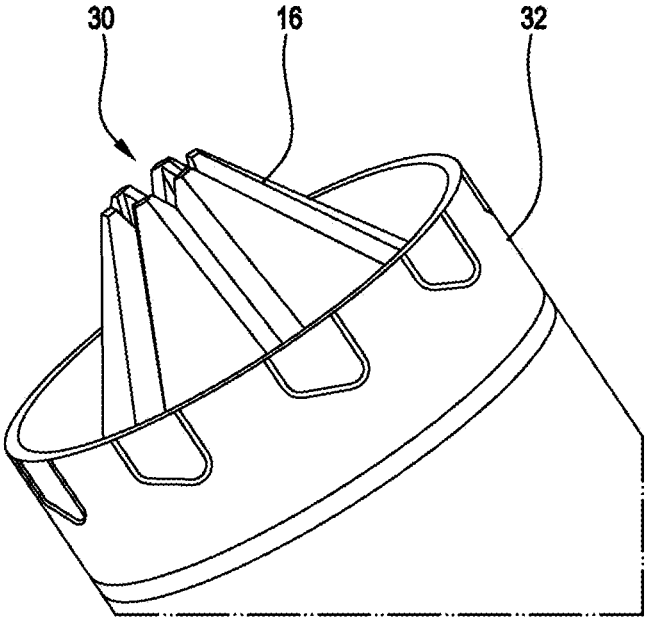
FIG. 15 shows a perspective view of a rear end of a front portion of the suppressor shown in FIG. 13.
Figure 16:
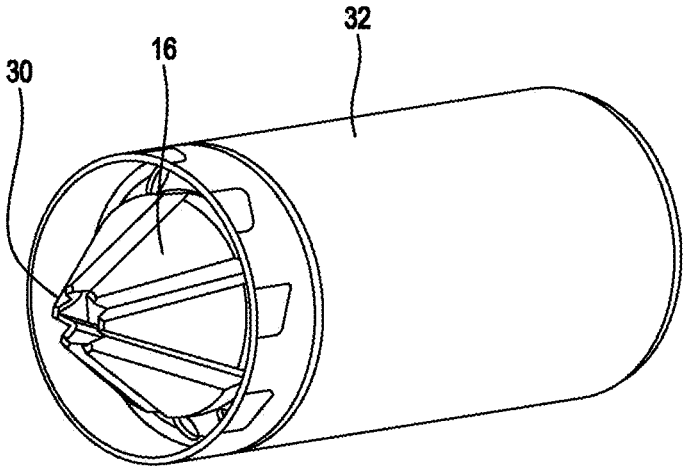
FIG. 16 is a rear perspective view of the front portion shown in FIG. 15.
Figure 17:
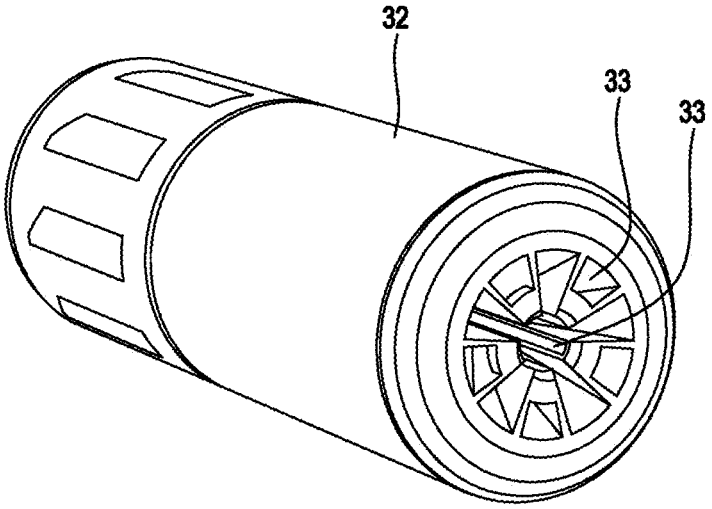
FIG. 17 shows a front perspective view of the front portion shown in FIG. 15.

FIGS. 15 and 16 show a front component 32 of the suppressor 10. In particular, these views show rear perspectives of the rearmost vane 16 and the labyrinth and/or piano key formation 30 to the rearmost bore baffle in the primary central axial flow path of the suppressor 10. FIG. 17 shows a front perspective view of the front component 32 of the suppressor 10 and depicts detail of exit ports 33 to assist with the inner chamber 12 venting to atmosphere. FIG. 18 shows a sectional view of a front portion of the front component 32, depicting the exit ports 33 being formed in a conical front structure 34. As can be seen, the exit ports 33 are each in the form of a passage which begins as a longitudinal slot along a bore wall and which terminates in a radial opening located at or near a front face of the suppressor 10.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

LIST OF REFERENCE NUMERALS

2 Diagonal weir type
4 Duckbill weir type
6 Labyrinth weir type
8 Piano key weir type
10 Suppressor
11 Tube
12 Inner chamber
13 Baffle stack
14 Outer chamber
15 First inner wall
16 Vane
17 Outer tube
18 Edge
19 Outer vanes
20 Formation
21 Central aperture
22 Gas flow direction
23 Gas flow across vanes
24 Inner volume showing an inner baffle stack
25 Radial exhaust ports
26 Outer volume having vane type elements in a radial array
27 Crowned circular wall
28 Inner baffle stack that can also have the labyrinth type vane elements applied to each edge
29 Wall defining a bore located on a primary central axial flow path
30 Labyrinth and/or piano key formation
31 Radial aperture
32 Front component of the suppressor

33 Exit ports

34 Conical front structure

The invention claimed is:

1. A firearm suppressor including an inner chamber, wherein the firearm suppressor includes at least one vane, the vane having an edge across which fluid flows, wherein said vane has a labyrinth and/or piano key formation applied to said edge to enhance energy dissipation as the fluid flows across the vane.

2. The firearm suppressor as claimed in claim 1, wherein the firearm suppressor includes an outer chamber surrounding the inner chamber, wherein the outer chamber extends longitudinally past a plurality of vanes forming a baffle stack so as to provide a fluid path bypassing the baffle stack.

3. The firearm suppressor as claimed in claim 1, wherein the firearm suppressor includes a wall defining a bore located on a primary central axial flow path of the firearm suppressor, and wherein the wall includes a labyrinth and/or piano key formation.

4. The firearm suppressor as claimed in claim 3, wherein the wall is circular and has said labyrinth and/or piano key formation on an edge of the wall.

5. The firearm suppressor as claimed in claim 3, wherein the wall has said labyrinth and/or piano key formation along an upstream circular edge of the wall.

6. The firearm suppressor as claimed in claim 1, wherein the labyrinth and/or piano key formation enhances energy dissipation of fluid flowing across the edge by extending a length of the edge of the vane when compared to a straight edge.

7. The firearm suppressor as claimed in claim 1, wherein the at least one vane includes a plurality of the vanes forming a baffle stack, each of the vanes having an edge across which fluid flows, wherein each of said edges has the labyrinth and/or the piano key formation applied to said edge to enhance energy dissipation as the fluid flows across the baffle stack.

8. A firearm suppressor including an inner chamber, wherein the firearm suppressor includes at least one vane, the vane having an edge across which fluid flows, wherein said vane has a formation applied to said edge to extend a length of the edge of the vane when compared to a straight edge.

9. The firearm suppressor as claimed in claim 8, wherein the firearm suppressor includes an outer chamber surrounding the inner chamber, wherein the outer chamber extends longitudinally past a plurality of vanes forming a baffle stack so as to provide a fluid path bypassing the baffle stack.

10. The firearm suppressor as claimed in claim 8, wherein the formation is a zig-zag, labyrinth, or piano key formation.

11. A firearm suppressor including an inner chamber, wherein the firearm suppressor includes at least one vane, the vane having an edge across which fluid flows, wherein said vane has a labyrinth weir formation applied to said edge to assist with energy dissipation as the fluid flows across the vane.

12. The firearm suppressor as claimed in claim 11, wherein the firearm suppressor includes an outer chamber surrounding the inner chamber, wherein the outer chamber extends longitudinally past a plurality of vanes forming a baffle stack so as to provide a fluid path bypassing the baffle stack.

13. The firearm suppressor as claimed in claim 12, wherein the labyrinth weir is in the form of a rectangular labyrinth weir, a triangular labyrinth weir, a trapezoidal labyrinth weir and/or a piano key weir.

14. The firearm suppressor as claimed in claim 8, wherein at least part of the firearm suppressor is 3D printed.

15. The firearm suppressor as claimed in claim 8, wherein the inner chamber is defined by an inner tubular wall and wherein the outer chamber is defined between the inner tubular wall and an outer tubular wall surrounding the inner tubular wall.

16. The firearm suppressor as claimed in claim 2, wherein the outer chamber includes at least one continuous radial vane.

17. The firearm suppressor as claimed in claim 9, wherein the outer chamber includes at least one continuous radial vane.

18. The firearm suppressor as claimed in claim 12, wherein the outer chamber includes at least one continuous radial vane.

* * * * *